US005475353A

United States Patent [19]

Roshen et al.

[11] Patent Number: 5,475,353

[45] Date of Patent: Dec. 12, 1995

[54] MICROMACHINED ELECTROMAGNETIC SWITCH WITH FIXED ON AND OFF POSITIONS USING THREE MAGNETS

[75] Inventors: Waseem A. Roshen, Clifton Park; Mario Ghezzo, Ballston Lake; Richard J. Saia, Niskayuna; William A. Hennessy; Bharat S. Bagepalli, both of Schenectady, all of N.Y.

[73] Assignee: General Electric Company, Schenectady, N.Y.

[21] Appl. No.: 315,520

[22] Filed: Sep. 30, 1994

[51] Int. Cl.[6] ..... H01H 51/22

[52] U.S. Cl. ..... 335/78; 335/177; 200/512

[58] Field of Search ..... 335/78–86, 628, 335/124, 177, 178, 179; 200/512; 333/232, 103–105

[56] References Cited

U.S. PATENT DOCUMENTS 4,674,180 6/1987 Zavracky et al. .
4,997,521 3/1991 Howe et al. ..... 156/651
5,121,089 6/1992 Larson ..... 333/107
5,374,792 12/1994 Ghezzo et al. ..... 200/16 B
5,386,115 1/1995 Freidhoff et al. ..... 250/281

*Primary Examiner*—Lincoln Donovan
*Attorney, Agent, or Firm*—Jill M. Breedlove; Marvin Snyder

[57] ABSTRACT

A micromachined electromagnetic switch, including two soft magnets situated in fixed positions above and below a permanent magnet, toggles between two fixed positions by the application of current in an actuator coil for a brief period. The permanent magnet is attached to a micromachined hinge or spring which moves under the action of a net force, thereby opening or closing the switch. Current in the actuator coil changes the relative strength of the magnetic forces due to the soft magnets. In the absence of current in the actuator coil, the switch is kept in the open or closed position by the attractive magnetic force between the permanent magnet and either the upper or lower soft magnet, whereby the stronger force is exercised between the permanent magnet and the nearest soft magnet.

5 Claims, 4 Drawing Sheets

MICROMACHINED ELECTROMAGNETIC SWITCH WITH FIXED ON AND OFF POSITIONS USING THREE MAGNETS

FIELD OF THE INVENTION

The present invention relates generally to micromachined electromagnetic switches and, more particularly, to a micromachined electromagnetic switch with fixed on and off positions using two soft magnets and one permanent magnet.

BACKGROUND OF THE INVENTION

For many electrical switching applications, it is necessary for a switch to remain open for relatively long periods of time. In order for a micromachined electromagnetic switch to operate in such manner, current in its actuator coil must flow continuously to keep the switch closed. Disadvantageously, this can lead to excessive losses in the coil and may result in undesirable heating. In addition, a reliable spring which can keep the switch in a fixed position is difficult to make by micromachining processes. Furthermore, to maintain such a switch in a fixed position, especially in the open position, a force greater than that which can be continuously applied by an actuator coil is often needed.

Accordingly, a micromachined electromagnetic switch is desirable which is capable of maintaining fixed on and off positions even for relatively long periods of time, as needed, without excessive heating and coil losses. Moreover, in order for such a switch to be practicable, it should be relatively easily and reliably manufactured.

SUMMARY OF THE INVENTION

A micromachined electromagnetic switch, comprising two soft magnets situated in fixed positions above and below a permanent magnet, toggles between two fixed positions by the application of current in an actuator coil for a brief period. The permanent magnet is attached to a micromachined hinge or spring which moves under the action of a net force, thereby opening or closing the switch. Current in the actuator coil changes the relative strength of the magnetic forces due to the interactions of the soft magnets with the moving permanent magnet. In the absence of current in the actuator coil, the switch is kept in the open or closed position by the attractive magnetic force between the permanent magnet and either the upper or lower soft magnet.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1A:
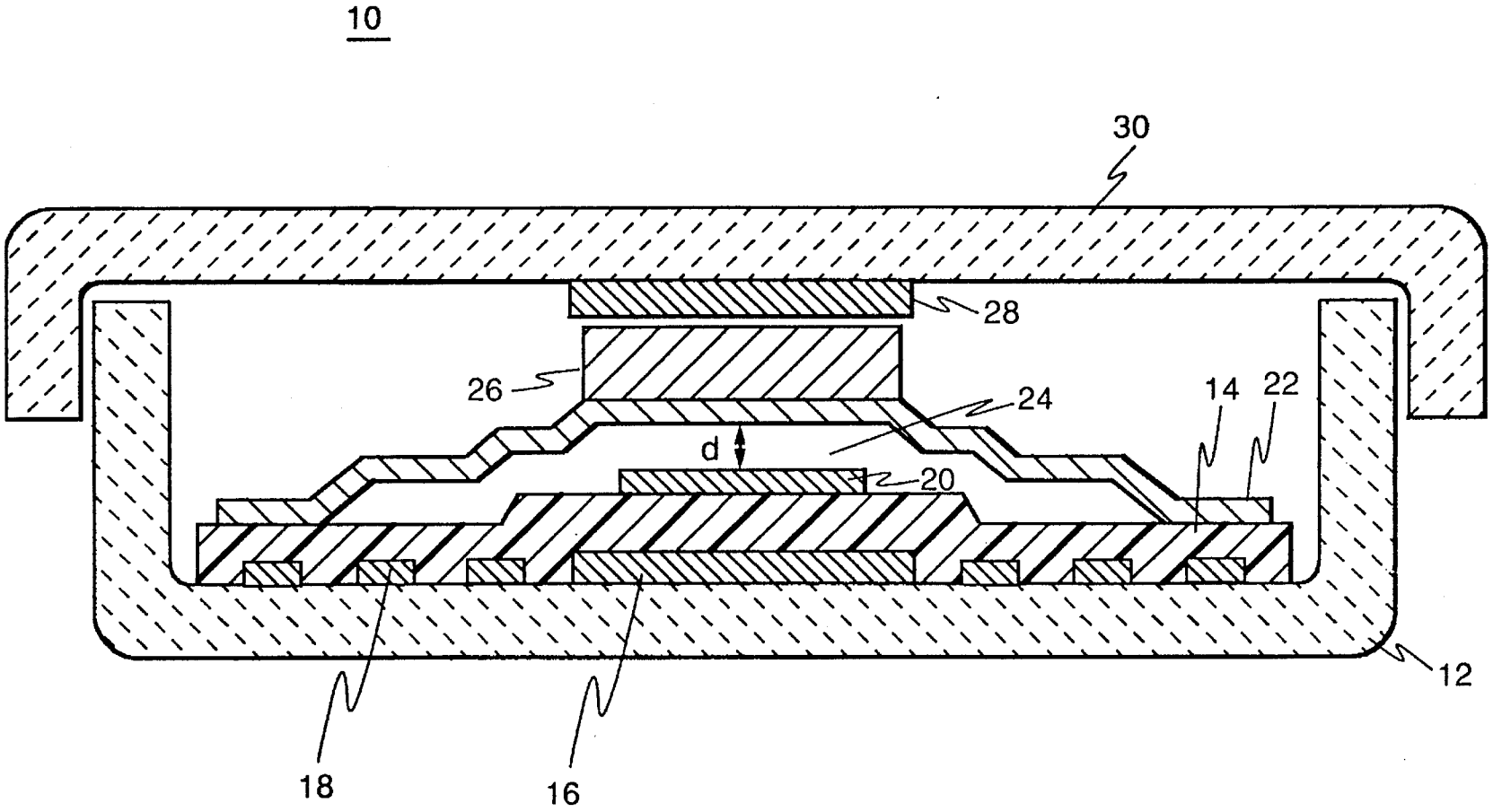
FIGS. 1*a* and 1*b* are cross sectional views of a micromachined electromagnetic switch in accordance with a preferred embodiment of the present invention.
Figure 1B:
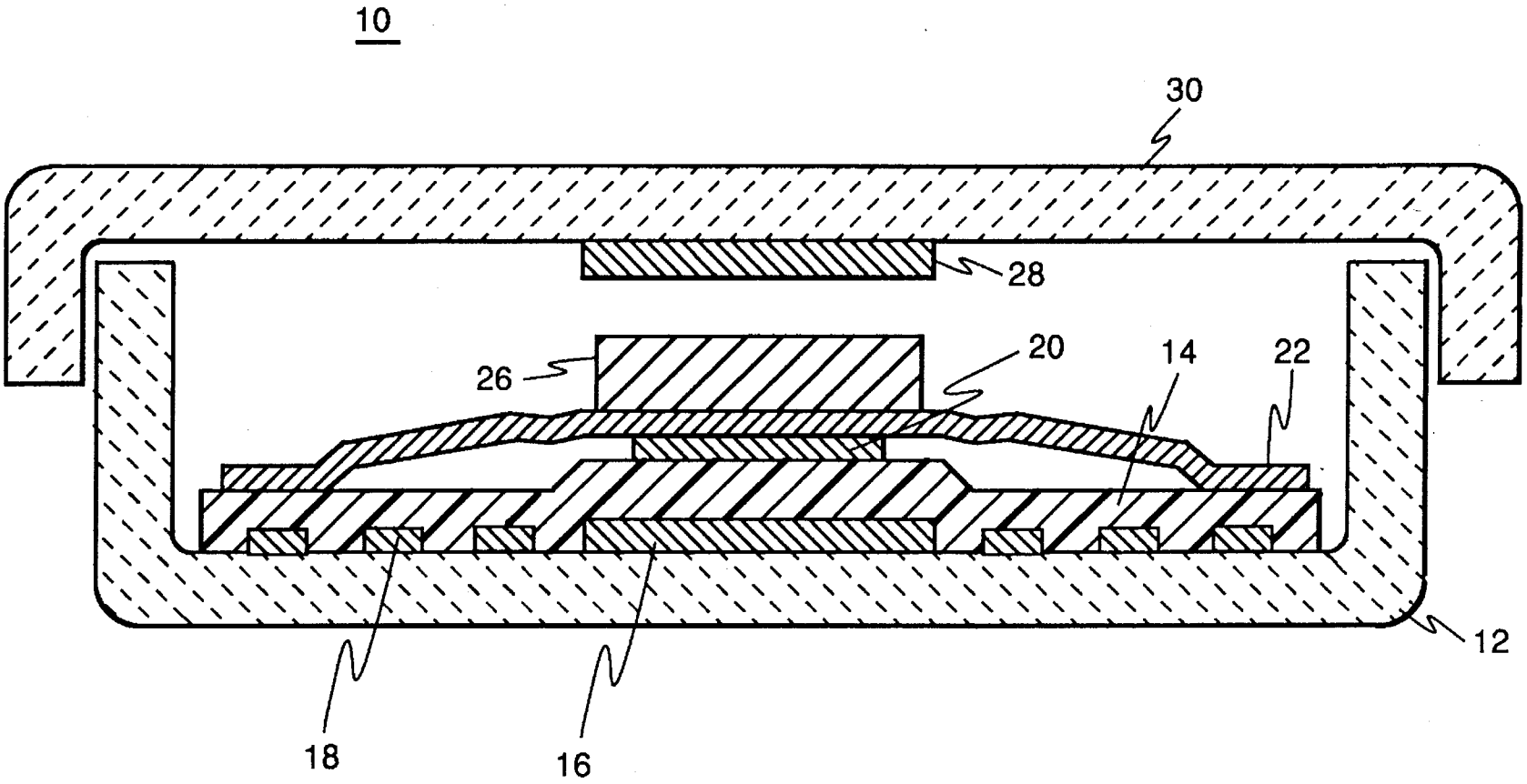

FIGS. 1*a*–1*b* illustrate a micromachined electromagnetic switch or actuator 10 according to the present invention.

Switch 10 includes a substrate 12, comprising any suitable structural material such as, for example, either silicon or a ceramic (e.g., alumina). An insulating layer 14 comprising a dielectric material such as, for example, a polyimide, such as Kapton polyimide of E.I. dupont de Nemours & Co., is disposed on substrate 12. A soft magnetic plate 16 comprising, for example, a ferrite, is embedded in dielectric layer 14. A soft magnetic material is briefly described as having a high magnetic permeability and a low remanence. The soft magnetic plate 16 is surrounded by an actuator coil 18, which is also embedded in dielectric layer 14.

A lower conductor 20 of switch 10 is disposed on dielectric layer 14. An upper conductor 22 is separated by an air gap 24 of length d from lower conductor 20. Conductors 20 and 22 are the two electrical terminals on the switched circuit. Upper conductor 22 acts a hinge or spring for the actuator. A permanent magnet 26 is disposed on and attached to the upper conductor. Another soft magnetic plate 28 is attached to a lid 30 of switch 10 in a fixed position with respect to the substrate 12.

Operation of micromachined electromagnetic switch 10 is as follows. In the absence of current in actuator coil 18, permanent magnet 26 is attracted to the upper and lower soft magnets 28 and 16, respectively, and attempts to move closer to whichever soft magnet generates a stronger mutual force, depending on the initial position of the permanent magnet. This force holds the permanent magnet in a fixed position.

The relative strength of the magnetic forces due to the two soft magnets can be changed by applying a current through the actuator coil, which can change the magnetization of the lower soft magnet 16 and upper soft magnet 28. In addition, the actuator current results in the application of a direct force on permanent magnet 26. A change of actuator current direction results in a reversal of the relative strength of the two magnetic forces due to the upper and lower soft magnets. Thus, if the magnetic force due to the upper soft magnet were dominant before application of the actuator current, then application of the current results in a dominant force due to the lower soft magnet. As a result, the permanent magnet moves from the upper, i.e., switch open, position, as shown in FIG. 1*a*, to the lower, i.e., switch closed, position, as shown in FIG. 1*b*. If the current were then removed from the actuator coil, the attractive force on the permanent magnet due to the lower soft magnet would still dominate such that the switch would remain closed. The reason is that magnetic forces decrease with the square of the distance. Thus, in this position, the permanent magnet is attracted more strongly by the nearby lower soft magnet than by the distant upper soft magnet. If a current were then applied to the coil in the opposite direction, the permanent magnet would move to the upper position, and the switch would open; and the switch would remain open after the removal of current from the coil, as explained above.

Advantageously, therefore, current is only needed in the actuator coil for a short period to toggle the switch between open and closed positions. Moreover, since current flows in the coil only for a short time, losses in the coil are minimal. In addition, when the switch closes, there is a greater force holding the switch in place, i.e., due to induced magnetization in the soft magnets, than in other micromachined electromagnet switches, providing improved electrical contact.

Figure 2:
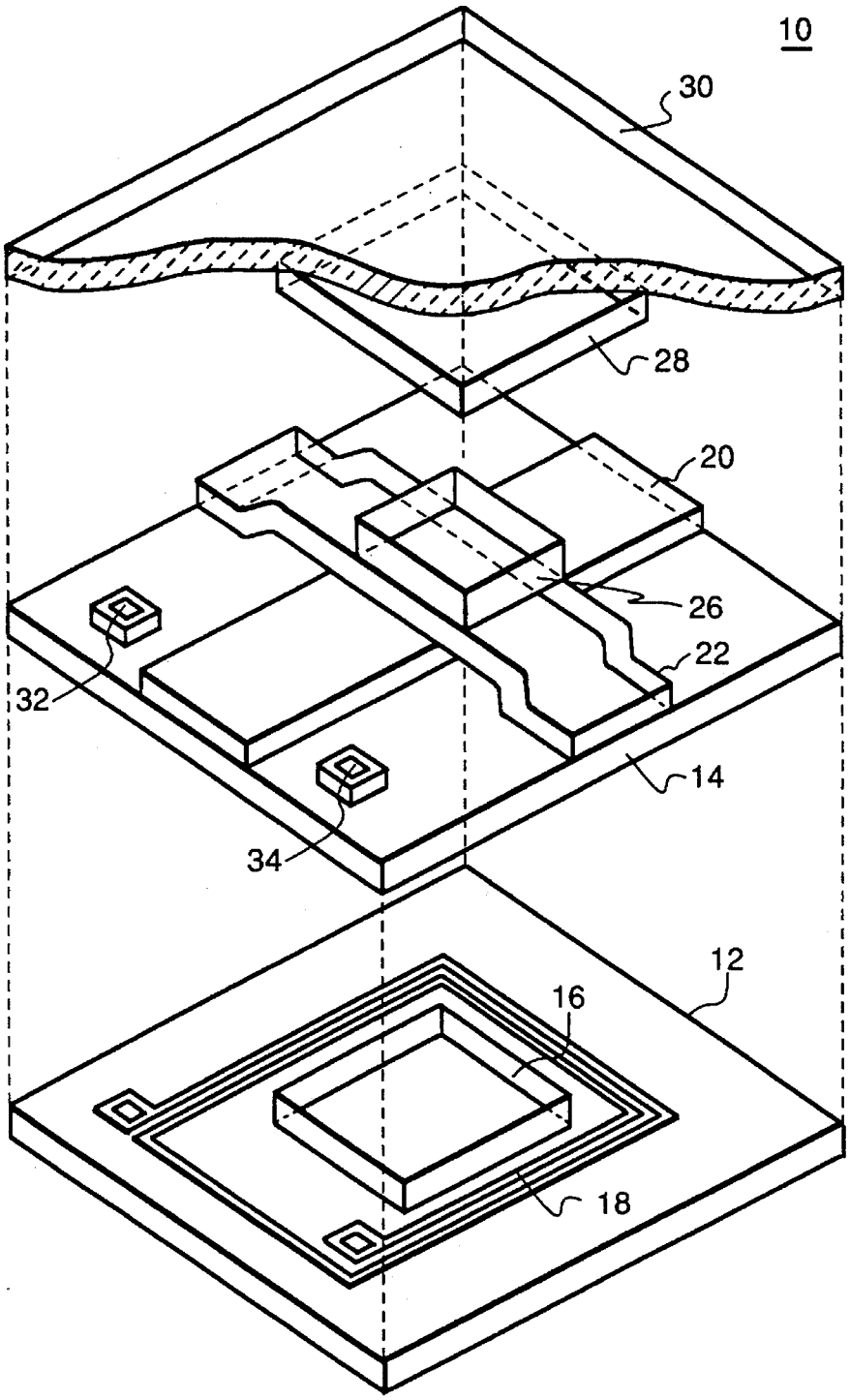
FIG. 2 is three-dimensional, exploded view of the switch of FIG. 1.

FIG. 2 illustrates a three-dimensional, exploded view of the electromagnetic switch of FIG. 1, showing in particular how leads 32 and 34 of actuator coil 18 are extended out from the device. Coil 18 is illustrated as a single-layer coil; alternatively, however, it may comprise a multi-layer coil, if desired or appropriate for a particular application. Moreover, coil 18 may be alternatively situated partially underneath soft magnet 16, if desired or appropriate, rather than completely outside the perimeter thereof, as shown.

Figure 3:
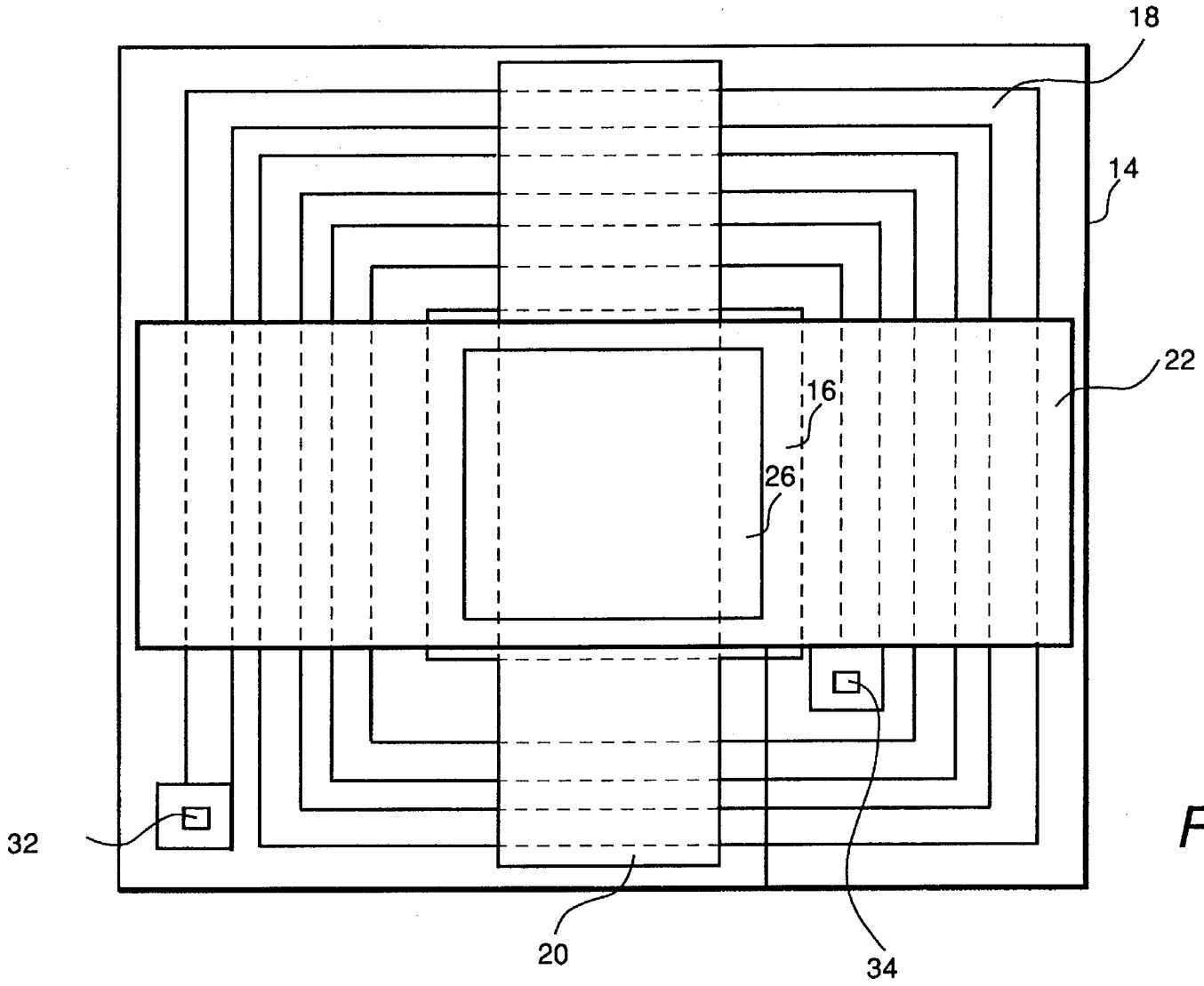
FIG. 3 is top view illustrating the layout of the switch of FIG. 1.

FIG. 3 illustrates the layout of the coil, the permanent magnet, the upper conductor of the switch (i.e., spring), and the contacts.

An electromagnetic switch according to the present invention may be fabricated using, for example, micromachining methods described in commonly assigned U.S. Pat. application Ser. No. 08/000,172 of M. Ghezzo et al., now allowed, and commonly assigned U.S. Pat. application Ser. No. 08/169,272 of R. J. Saia et al., both of which are incorporated by reference herein.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electromagnetic switch, comprising:

a container comprising a substrate and a lid;

a dielectric layer disposed on said substrate;

a lower soft magnet embedded within said dielectric layer;

an actuator coil embedded within said dielectric layer and situated about said lower soft magnet;

a lower conductor disposed on said dielectric layer;

an upper conductor situated above and separated from said lower conductor by an air gap;

a permanent magnet disposed on said upper conductor and situated above said lower conductor; and an upper soft magnet attached to said lid and situated above said permanent magnet;

the switch being toggled between fixed open and closed positions through application of current to said actuator coil for affecting magnetization of said upper and lower soft magnets, the switch remaining in one of said positions upon removal of said current, the switch toggling to the other of said positions upon application of current to said actuator coil in an opposite direction.

2. The electromagnetic switch of claim 1 wherein said substrate comprises silicon.

3. The electromagnetic switch of claim 1 wherein said substrate comprises a ceramic.

4. The electromagnetic switch of claim 1 wherein said dielectric layer comprises a polyimide.

5. The electromagnetic switch of claim 1 wherein said lower soft magnet and said upper soft magnet each comprise a ferrite.

* * * * *